US012392504B2

(12) United States Patent
Zhang

(10) Patent No.: US 12,392,504 B2
(45) Date of Patent: Aug. 19, 2025

(54) FLOOR-STANDING AIR CONDITIONER INDOOR UNIT AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventor: Qiang Zhang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 465 days.

(21) Appl. No.: 17/916,990

(22) PCT Filed: Mar. 23, 2021

(86) PCT No.: PCT/CN2021/082367
§ 371 (c)(1),
(2) Date: Oct. 4, 2022

(87) PCT Pub. No.: WO2021/218495
PCT Pub. Date: Nov. 4, 2021

(65) Prior Publication Data

US 2023/0160583 A1 May 25, 2023

(30) Foreign Application Priority Data

Apr. 27, 2020 (CN) ..... 202010348581.3
Apr. 27, 2020 (CN) ..... 202020673568.0
Apr. 27, 2020 (CN) ..... 202110157315.7

(51) Int. Cl.
*F24F 1/005* (2019.01)
*F24F 1/0071* (2019.01)
(Continued)

(52) U.S. Cl.
CPC ..... *F24F 1/005* (2019.02); *F24F 1/0071* (2019.02); *F24F 1/0083* (2019.02);
(Continued)

(58) Field of Classification Search
CPC ..... F24F 1/003; F24F 1/0071; F24F 1/0073; F24F 1/0083; F24F 1/0087; F24F 1/0043;
(Continued)

(56) References Cited

FOREIGN PATENT DOCUMENTS

CN 102338421 A 2/2012
CN 102466281 A 5/2012
(Continued)

OTHER PUBLICATIONS

Machine Translation of CN 110986166 (Year: 2020).*
(Continued)

*Primary Examiner* — Steven B McAllister
*Assistant Examiner* — Amy E Carter
(74) *Attorney, Agent, or Firm* — Anova Law Group, PLLC

(57) ABSTRACT

A floor-standing air conditioner indoor unit includes a main unit and a sub-unit detachably connected to the main unit. The main unit includes an indoor heat exchange module. The sub-unit includes an air treatment module configured to operate independently in a scenario that the sub-unit is separated from the main unit.

18 Claims, 21 Drawing Sheets

(51) Int. Cl.
*F24F 1/0083* (2019.01)
*F24F 1/0087* (2019.01)
*F24F 13/32* (2006.01)

(52) U.S. Cl.
CPC ..... *F24F 1/0087* (2019.02); *F24F 13/32* (2013.01); *F24F 2221/36* (2013.01)

(58) Field of Classification Search
CPC .. F24F 1/005; F24F 11/56; F24F 11/58; F24F 13/32; F24F 13/0272; F24F 2221/12; F24F 2221/125; F24F 2221/36; F24F 3/14; F24F 8/20
See application file for complete search history.

(56) References Cited

FOREIGN PATENT DOCUMENTS

| | | | | | |
|---|---|---|---|---|---|
| CN | 204063389 | U | | 12/2014 | |
| CN | 205006815 | U | * | 2/2016 | |
| CN | 205481431 | U | | 8/2016 | |
| CN | 206890682 | U | | 1/2018 | |
| CN | 206944341 | U | * | 1/2018 | |
| CN | 109394099 | A | * | 3/2019 | ..... A47L 11/24 |
| CN | 110986166 | A | * | 4/2020 | |
| CN | 212132686 | U | | 12/2020 | |
| KR | 100236018 | B1 | * | 12/1999 | ..... F24F 13/1426 |
| KR | 20050099800 | A | * | 10/2005 | |
| KR | 20120036143 | A | * | 4/2012 | ..... F24F 13/20 |
| WO | WO-2006071070 | A2 | * | 7/2006 | ..... F24F 1/0011 |

OTHER PUBLICATIONS

Machine Translation of CN 205006815 (Year: 2016).*
Machine Translation of KR 20050099800 (Year: 2005).*
Machine Translation of KR 20120036143 (Year: 2012).*
CN 206944341 with Machine Translation (Year: 2018).*
Machine Translation of CN 109394099 (Year: 2019).*
KR-100236018 with Translation (Year: 1999).*
World Intellectual Property Organization (WIPO) International Search Report and Written opinion for PCT/CN2021/082367 Jun. 16, 2021 16 Pages (Translation Included).
The China National Intellectual Property Administration (CNIPA) The First Office Action for Chinese Application 202110157315.7, Mar. 15, 2022 22 Pages (With Translation).
The China National Intellectual Property Administration (CNIPA) The Second Office Action for Chinese Application 202110157315.7, Aug. 15, 2022 25 Pages (With Translation).

* cited by examiner

FLOOR-STANDING AIR CONDITIONER INDOOR UNIT AND AIR CONDITIONER

CROSS-REFERENCE TO RELATED APPLICATIONS

This application is a National Stage Entry under 35 U.S.C. § 371 of International Application No. PCT/CN2021/082367, filed on Mar. 23, 2021, which claims priority to Chinese Patent Application Nos. 202010348581.3, 202020673568.0 and 202110157315.7, all filed on Apr. 27, 2020, the entire contents of all of which are incorporated herein by reference.

TECHNICAL FIELD

The present disclosure relates to the technical field of air conditioning, and in particular, to a floor-standing air conditioner indoor unit and an air conditioner.

BACKGROUND

Nowadays, the functions of air-conditioning products on the market are diversified, such as air-conditioning products that integrate heat exchange, purification, humidification and other functions. However, this kind of multifunctional air conditioner occupies a large space, the position of the multifunctional floor-standing air conditioner is relatively fixed, and the effects of heat exchange, purification, and humidification are not ideal.

The above statements merely provide background information related to the present disclosure and may not constitute prior art.

SUMMARY

The main objective of the present disclosure is to provide a floor-standing air conditioner indoor unit, which aims to solve the technical problem that the position of the multifunctional floor-standing air conditioner indoor unit is relatively fixed.

In order to achieve the above objective, the present disclosure provides a floor-standing air conditioner indoor unit, including: a main unit including an indoor heat exchange module, and a sub-unit detachably connected to the main unit. The sub-unit includes an air treatment module, and when the sub-unit is separated from the main unit, the air treatment module operates independently.

In an embodiment, the sub-unit includes a sub-unit body, a control device and a mobile device, the air treatment module is installed in the sub-unit body, the mobile device is installed at a bottom of the sub-unit body, and the control device is configured to control the mobile device to drive the sub-unit body to move.

In an embodiment, a storage cavity is formed in the main unit, and the sub-unit is at least partially installed in the storage cavity.

In an embodiment, the main unit extends in a vertical direction, the storage cavity is located below the main unit, a side wall of the main unit is provided with an installation opening communicating with the storage cavity, and the control device is configured to control the mobile device to drive the sub-unit body to enter and separate from the storage cavity through the installation opening.

In an embodiment, the main unit further includes a main unit body and a switch door, the indoor heat exchange module is installed in the main unit body, the storage cavity is formed in the main unit body, a side wall of the main unit body is provided with the installation opening, and the switch door is opened or closed to cover the installation opening.

In an embodiment, the switch door is detachably connected to the main unit body to open or close the installation opening; or the switch door is rotatably connected to the main unit body to open or close the installation opening; or the switch door is slidably connected to the main unit body to open or close the installation opening.

In an embodiment, the main unit further includes a drive device, and the drive device is connected to the switch door to drive the switch door to rotate to open the installation opening or slide to open the installation opening.

In an embodiment, the drive device includes a drive motor, a gear, and a rack structure meshed with the gear, the gear is installed at the main unit body, the rack structure is installed at the switch door, the drive motor is connected to the gear, to drive the gear to drive the rack structure to move, so that the switch door is configured to open or close the installation opening.

In an embodiment, one of the switch door and the main unit body is provided with a guide rail, the other one of the switch door and the main unit body is provided with a guide groove matching the guide rail, an extension direction of the guide rail is consistent with an extension direction of the rack structure, and when the switch door opens the installation opening, the switch door is located in the storage cavity.

In an embodiment, the rack structure extends in the vertical direction, to make the switch door open or close the installation opening in the vertical direction; or the rack structure is installed at an inner side of the switch door, the rack structure extends in a width direction of the switch door, to make the switch door open or close the installation opening in a circumferential direction of the main unit body.

In an embodiment, the main unit includes at least two drive devices; when the rack structure extends in the vertical direction, two of the drive devices are provided at both ends of the switch door in the width direction; or when the rack structure extends in the width direction of the switch door, two of the drive devices are provided at both ends of the switch door in the vertical direction.

In an embodiment, the switch door includes two sub-doors, and the two sub-doors are arranged side by side in a width direction of the installation opening.

In an embodiment, the floor-standing air conditioner indoor unit further includes an electric control box, and a sensing device electrically connected to the electric control box. The electric control box is installed at the main unit body, and the electric control box is configured to control the drive device to drive the switch door to open after receiving a start-up signal from the sub-unit. The electric control box is further configured to control the drive device to drive the switch door to open when the sensing device senses that the sub-unit moves outside the main unit to approach the main unit. The electric control box is further configured to control the drive device to drive the switch door to close when the sensing device senses that the sub-unit is repositioned in the storage cavity, and/or the sub-unit is separated from the storage cavity.

In an embodiment, the sensing device includes a signal receiver and a signal generator, the signal generator is installed at the sub-unit body, the signal receiver is installed at the main unit body; and the signal receiver is configured to transmit a signal for opening the switch door to the electric control box when the signal receiver senses that the sub-unit moves outside the main unit to approach the main unit through the signal generator.

In an embodiment, the signal receiver is further configured to transmit a signal for closing the switch door to the electric control box when the signal receiver senses that the sub-unit is far away from the main unit through the signal generator; or the sensing device further includes a body sensor, and the body sensor is configured to transmit a signal for closing the switch door to the electric control box when the body sensor senses that the sub-unit is separated from the storage cavity.

In an embodiment, the sensing device further includes a sub-unit magnetic attraction module and a main unit magnetic attraction module; the sub-unit magnetic attraction module is installed at the sub-unit; the main unit magnetic attraction module is installed at an inner wall surface of the storage cavity; and after the sub-unit is moved to the storage cavity and the sub-unit magnetic attraction module is docked with the main unit magnetic attraction module, the sensing device is configured to transmit a signal for closing the switch door to the electric control box.

In an embodiment, the sub-unit and the main unit are spliced with each other.

In an embodiment, a top of the sub-unit is spliced with a bottom of the main unit.

In an embodiment, the indoor heat exchange module has a heat exchange air duct, the air treatment module has an air treatment air duct, and when the sub-unit is connected to the main unit, the heat exchange air duct and the air treatment air duct are isolated from each other.

In an embodiment, the air treatment module includes at least one of an air supply assembly, a purification assembly, a humidification assembly, a dehumidification assembly, a sterilization assembly, or an aromatherapy assembly.

The present disclosure further provides an air conditioner, including an air conditioner outdoor unit, and a floor-standing air conditioner indoor unit, the air conditioner outdoor unit being in communication with the floor-standing air conditioner indoor unit through a refrigerant pipe. The floor-standing air conditioner indoor unit includes a main unit and a sub-unit.

The main unit includes an indoor heat exchange module. A storage cavity is formed in the main unit.

The sub-unit is detachably installed in the storage cavity, the sub-unit includes an air treatment module, and when the sub-unit is separated from the main unit, the air treatment module operates independently.

The present disclosure provides a floor-standing air conditioner indoor unit, the sub-unit is detachably connected to the main unit, and the sub-unit can operate independently from the main unit. While ensuring the rapid heat exchange in the whole room, the sub-unit can be separated from the main unit to realize mobile air supply, purification, humidification, etc. The air supply demand of a certain area or the entire area in the room can be flexibly adjusted through the sub-unit, so that the entire floor-standing air conditioner indoor unit is highly flexible and can meet the different air supply demands of users. In addition, while the floor-standing air conditioner indoor unit has the functions of heat exchange, air purification, and humidification, the sub-unit is connected to the main unit, thereby realizing the integration of multiple units, saving room space, and improving space utilization.

BRIEF DESCRIPTION OF THE DRAWINGS

In order to more clearly illustrate the technical solutions in the embodiments of the present disclosure or in the prior art, the following briefly introduces the accompanying drawings that need to be used in the description of the embodiments or the prior art. Obviously, the drawings in the following description are only some embodiments of the present disclosure, For those of ordinary skill in the art, other drawings can also be obtained based on the structures shown in these drawings without any creative effort.

DETAILED DESCRIPTION OF THE EMBODIMENTS

Figure 1:
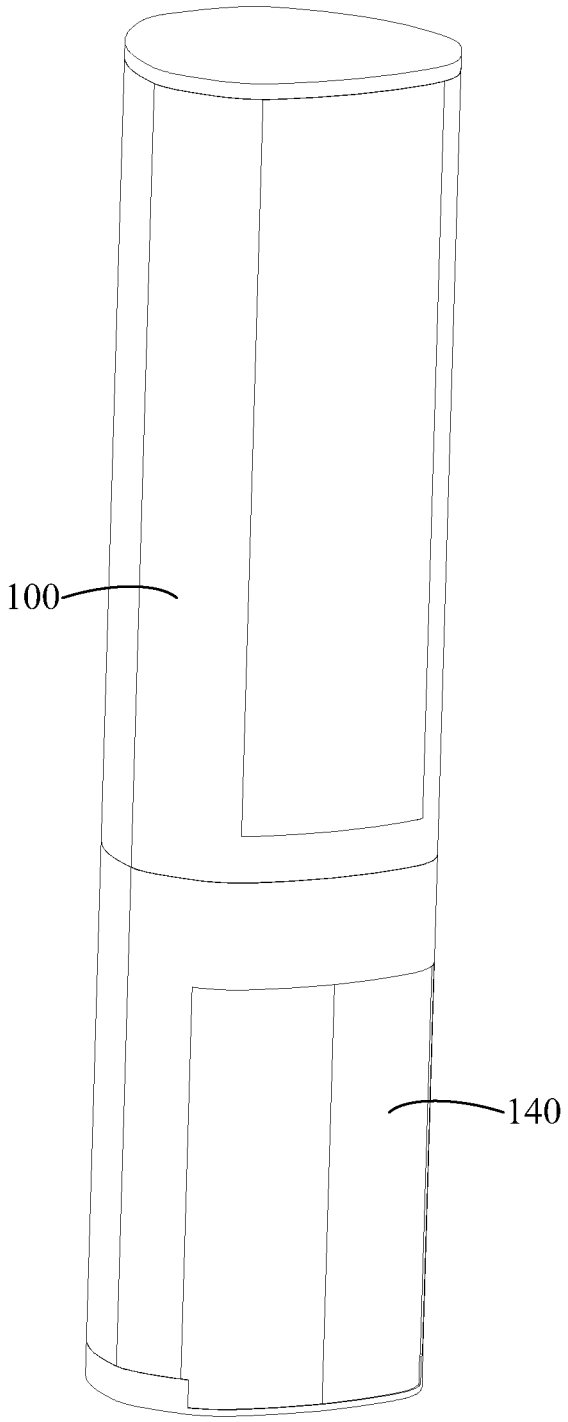
FIG. 1 is a schematic structural view of a floor-standing air conditioner indoor unit according to an embodiment of the present disclosure.

It should be noted that, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. Besides, the meaning of "and/or" appearing in the disclosure includes three parallel scenarios. For example, "A and/or B" includes only A, or only B, or both A and B.

The present disclosure provides a floor-standing air conditioner indoor unit.

In some embodiments of the present disclosure, as shown in FIG. 1 to FIG. 3, and FIG. 15 to FIG. 18, the floor-standing air conditioner indoor unit includes a main unit 100 and a sub-unit 200. The main unit 100 includes an indoor heat exchange module. The sub-unit 200 is detachably connected to the main unit 100. The sub-unit 200 includes an air treatment module, and when the sub-unit 200 is separated from the main unit 100, the air treatment module operates independently.

In an embodiment, the main unit 100 and the sub-unit 200 may be in a cylindrical shape, an elliptical cylindrical shape, a square cylindrical shape or other shapes as a whole, which may be selected and designed according to actual usage requirements, and are not limited herein. The main unit 100 extends in the vertical direction. The cross-sectional areas of the main unit 100 and the sub-unit 200 in the vertical direction may be the same or different. The main unit 100 and the sub-unit 200 may have the same shape or different shapes. The indoor heat exchange module has a heat exchange air duct 190, and the air treatment module has an air treatment air duct 250. When the sub-unit 200 is connected to the main unit 100, the heat exchange air duct 190 and the air treatment air duct 250 may be isolated from each other or communicated with each other. In practice, when the sub-unit 200 is connected to the main unit 100, the heat exchange air duct 190 and the air treatment air duct 250 are isolated from each other. In this way, the heat exchange air duct 190 and the air treatment air duct 250 are independent of each other and do not affect each other. Therefore, when the sub-unit 200 is connected to and separated from the main unit 100, the heat exchange effect of the indoor heat exchange module will not be affected, and the heat exchange stability of the entire floor-standing air conditioner indoor unit is ensured.

The indoor heat exchange module is used for exchanging heat for the airflow flowing through the heat exchange air duct 190 to cool or heat the room. The indoor heat exchange module can only have a cooling function, or can have both cooling and heating functions. It can be understood that the main unit 100 further includes a heat exchange air inlet and a heat exchange air outlet which are communicated with the heat exchange air duct 190. The heat exchange air duct 190 is provided with a heat exchange assembly, and the heat exchange assembly includes a heat exchanger and a heat exchange fan. The heat exchange fan drives the air flow into the heat exchange air duct 190 from the heat exchange air inlet, and is blown out from the heat exchange air outlet after heat exchange through the heat exchanger, thereby cooling or heating the room. The indoor heat exchange module also includes a refrigerant pipe, a compressor and other structures, and the specific structure can refer to the existing technology of the floor-standing air conditioner indoor unit, which will not be repeated herein. The air treatment module has an air treatment duct 250, the sub-unit body 210 is provided with an air inlet and an air outlet communicating with the air treatment duct 250, and the air outlet is formed at the side wall and/or the top wall of the sub-unit body 210. As such, the air entering the air treatment duct 250 from the air inlet is processed by the air treatment module and then blown out from the air outlet to realize functions such as air supply, humidification, dehumidification, and sterilization. Specifically, the air outlet may be formed at the side wall and the top wall of the sub-unit body 210. In this way, the sub-unit 200 is ventilated in the circumferential direction and at the top, so that the air supply range is wider and the air treatment effect is better.

The sub-unit 200 is detachably connected to the main unit 100, the sub-unit 200 can be connected inside the main unit 100, for example, a storage cavity 110 is provided inside the main unit 100, such that the sub-unit 200 is installed in the storage cavity 110, and the storage cavity 110 may be located at the upper, the middle or the lower of the main unit 100 at this time.

The sub-unit 200 may also be connected outside the main unit 100, such as being spliced to the bottom, top, and periphery of the main unit 100. The connection between the sub-unit 200 and the main unit 100 may be a structural connection, for example, a connection through a snap connection, a magnetic connection, a plug connection, or the like. The connection between the sub-unit 200 and the main unit 100 may also be a circuit connection, for example, the sub-unit 200 is charged through the main unit 100. The connection between the sub-unit 200 and the main unit 100 can also be only a channel connection, such as making the air treatment duct of the sub-unit 200 communicate with the air duct in the main unit 100, such as the fresh air duct and the heat exchange air duct of the main unit 100. It can be understood that the sub-unit 200 can be separated from the main unit 100 manually by the user, or the sub-unit 200 can be actively separated from the main unit 100 by controlling the control device without manual operation by the user. When the sub-unit 200 is separated from the main unit 100, the sub-unit 200 can circulate and move indoors autonomously, so as to meet the needs of the whole indoor air treatment and make the whole space evenly supplied with air. The sub-unit 200 can also be moved manually by the user to a desired position indoors, or the sub-unit 200 can be moved autonomously to a certain position, such as an area where many people are concentrated.

Therefore, it can meet the fixed-point air supply in a certain area, realize long-distance, fixed-point and directional air supply, and improve the air treatment effect. Compared with moving the entire floor-standing air conditioner indoor unit, the movement of the sub-unit 200 is more flexible and convenient, so that it can meet the different usage needs of users.

The number of the sub-units 200 may be one, two or more, and the plurality of sub-units 200 may be arranged in the vertical direction, or may be located in the same horizontal direction. At this time, only one heat exchange air duct and heat exchange assembly may be provided in the main unit 100, or two or more sets of heat exchange air ducts and heat exchange assemblies may be provided. The separation forms of the plurality of sub-units 200 and the main unit 100 may be the same or different. The air treatment module includes at least one of an air supply assembly, a purification assembly, a humidification assembly, a dehumidification assembly, a sterilization assembly, or an aromatherapy assembly. Specifically, the air supply assembly may be a fan, and the air flow is driven by the turbine, thereby realizing the air supply function of the sub-unit 200. The air supply assembly may further include an electric heating body, and through the electric heating, the sub-unit 200 has the function of supplying hot air. The purification assemblies may include HEPA nets, formaldehyde, TVOC, toluene and other gaseous pollutant filters, water cleaning modules, electrostatic dust removal modules, etc., which will not be listed here. The purifying assembly is provided so that the sub-unit 200 can purify the air, so as to satisfy the user's requirements such as dust removal and air purification. The humidification assembly may specifically be a wet curtain assembly or the like. Specifically, the dehumidification assembly may include a condenser and an evaporator, and the dehumidification function is realized by the condenser, and the overall constant temperature dehumidification is realized by heating by the evaporator. By setting the humidification assembly and the dehumidification assembly, the sub-unit 200 has the functions of humidification and dehumidification, so as to meet the user's requirements for air humidity. The sterilization assembly may include an ultraviolet sterilization module, an anion sterilization module, or the like. By setting the sterilization assembly, the sub-unit 200 has a sterilization function, which is suitable for places with many bacteria and viruses, so as to meet the user's demand for air sterilization and disinfection. The aromatherapy assembly may include ultrasonic vibration equipment, so as to nano-atomize water molecules and plant essential oils, add fragrance to the room, and eliminate odors. The air treatment module may choose different functions and add different assemblies according to the use needs, and the combination forms are not listed one by one here. After the sub-unit 200 is separated from the main unit 100, the air treatment module can work independently, so that the sub-unit 200 has different functions. When there are two or more sub-units 200, the functions of the air treatment modules of each sub-unit 200 may be the same or different.

The present disclosure provides a floor-standing air conditioner indoor unit, the sub-unit 200 is detachably connected to the main unit, and the sub-unit 200 can operate independently from the main unit. While ensuring the rapid heat exchange in the whole room, the sub-unit 200 can be separated from the main unit 100 to realize mobile air supply, purification, humidification, etc. The air supply demand of a certain area or the entire area in the room can be flexibly adjusted through the sub-unit 200, so that the entire floor-standing air conditioner indoor unit is highly flexible and can meet the different air supply demands of users. In addition, while the floor-standing air conditioner indoor unit has the functions of heat exchange, air purification, and humidification, the sub-unit 200 is connected to the main unit 100, thereby realizing the integration of multiple units, saving room space, and improving space utilization.

Figure 3:
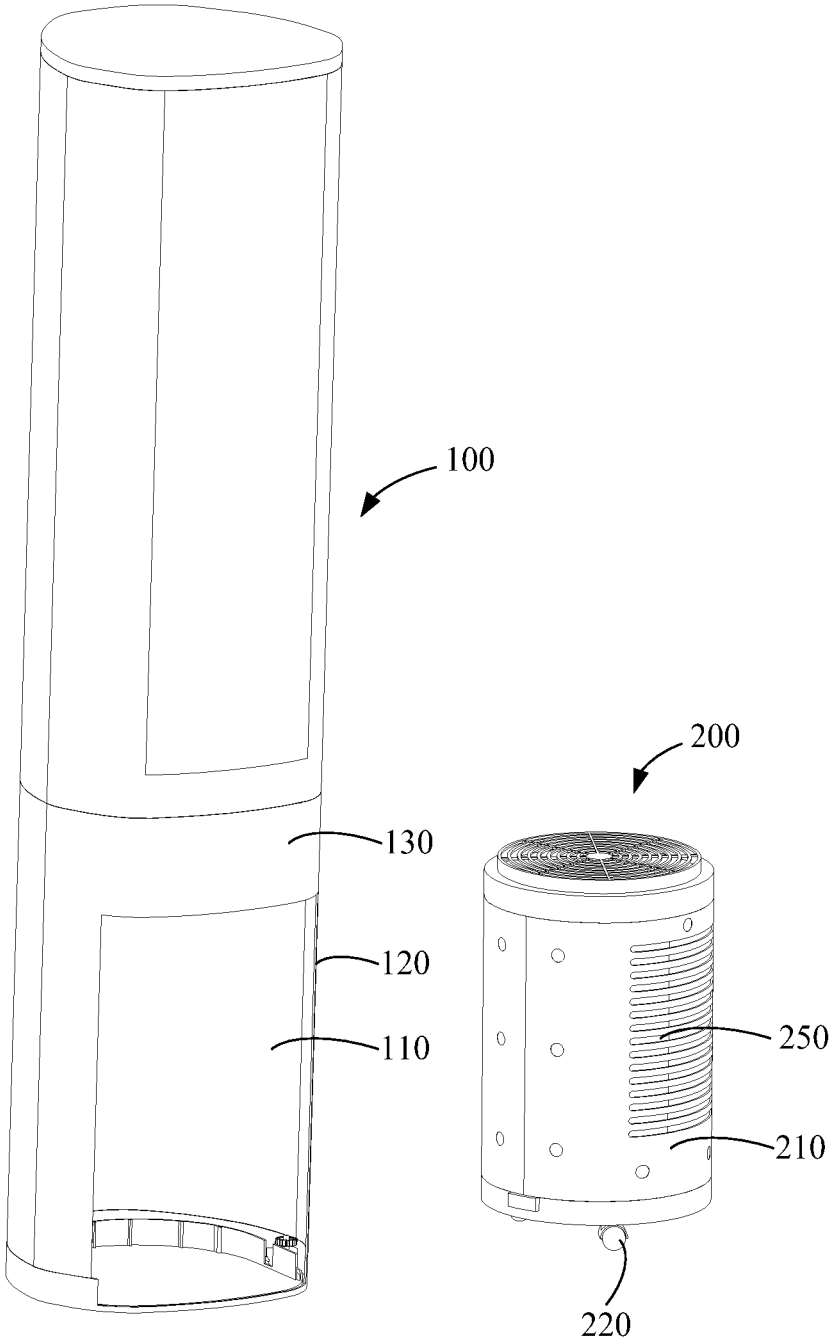
FIG. 3 is a schematic structural view of the floor-standing air conditioner indoor unit in FIG. 1, the switch door is opened, and the sub-unit is located outside the storage cavity.
Figure 4:
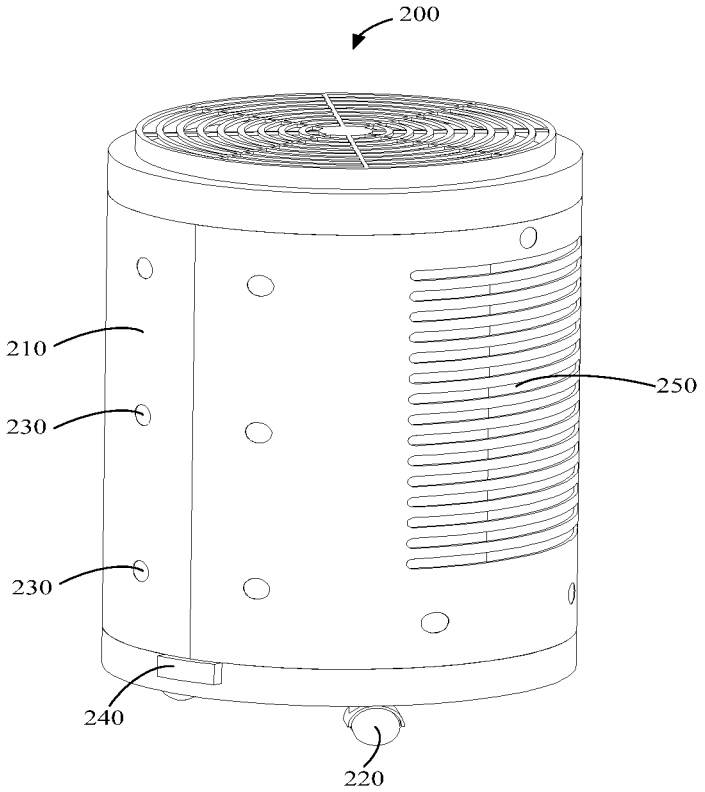
FIG. 4 is a schematic structural view of a sub-unit of the floor-standing air conditioner indoor unit in FIG. 1.
Figure 5:
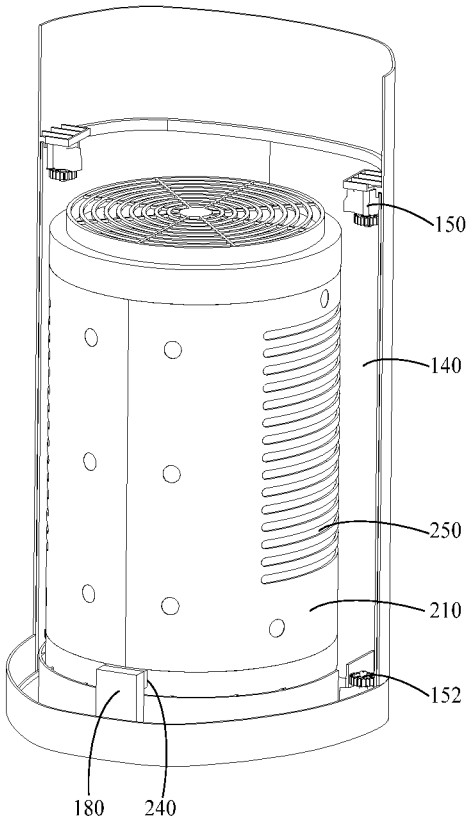
FIG. 5 is a partial schematic structural view of the floor-standing air conditioner indoor unit in FIG. 1.

In an embodiment, as shown in FIG. 3 to FIG. 5, the sub-unit 200 includes a sub-unit body 210, a control device and a mobile device 220, the air treatment module is installed in the sub-unit body 210, the mobile device 220 is installed at a bottom of the sub-unit body 210, and the control device is configured to control the mobile device 220 to drive the sub-unit body 210 to move.

In this embodiment, the mobile device 220 may be a drive wheel plus a universal wheel, a roller plus a turntable, etc. The mobile device 220 can drive the sub-unit body 210 to move and turn, thereby realizing multi-directional movement in the entire room. The control device may be installed in the sub-unit body 210, and the user may send a signal to the control device by means of wireless transmission or infrared remote control, and then control the movement of the mobile device 220. A program can also be written in the control board, so that the sub-unit 200 can move autonomously. It can be understood that the movement of the sub-unit 200 may be controlled in real time by means of remote control, mobile phone APP remote control, or the like, or the location, time, movement path, etc. of the movement of the sub-unit 200 may be preset. It is also possible to provide the infrared sensor, ultrasonic sensor and other obstacle avoidance sensors on the sub-unit 200, so that the sub-unit 200 can avoid obstacles and move autonomously. The control device controls the sub-unit 200 to have various action modes, such that the sub-unit 200 is equivalent to an air-conditioning robot, which can adjust the moving direction according to the feedback of the indoor environment, and independently plan the walking route, so as to ensure that the sub-unit 200 can avoid obstacles and walk flexibly. It is also possible to provide temperature, humidity or pollutant sensors, etc., so that the sub-unit 200 can detect the environmental state of a certain area during the movement process, so as to independently determine whether to leave or stay for continuous air supply. A visual sensor can also be provided on the sub-unit 200, and the panoramic image of the house can be captured by moving the sub-unit 200, which can be uploaded to the cloud system, so that the user can observe the movement of the sub-unit 200 at any time through smart devices such as mobile phones, tablets, and computers. The sub-unit 200 may be controlled to be separated from the main unit 100 by the above control device.

In practical applications, the sub-unit 200 also has a power source. The power source includes a battery and a charging module. The battery is configured to store the electric energy of the charging module and is connected with the control device. The charging module may be a wireless charging module, a powerful electrode sheet, a direct charging module, and the like. When the power of the sub-unit 200 is insufficient, wireless charging, contact charging, or charging by prompting the user can be implemented. The sub-unit 200 can be automatically returned to the main unit 100 for charging, or an additional charging stand can be provided for charging, and the sub-unit 200 can be automatically positioned and moved to the charging stand through the positioning device for charging. If the electric energy is stored in the storage battery, the sub-unit 200 can continue to work after being charged, with a long battery life and good battery life.

Further, as shown in FIG. 2, FIG. 3, FIG. 15 and FIG. 16, the main unit 100 defines the storage cavity 110, and the sub-unit 200 is at least partially installed in the storage cavity 110.

Figure 2:
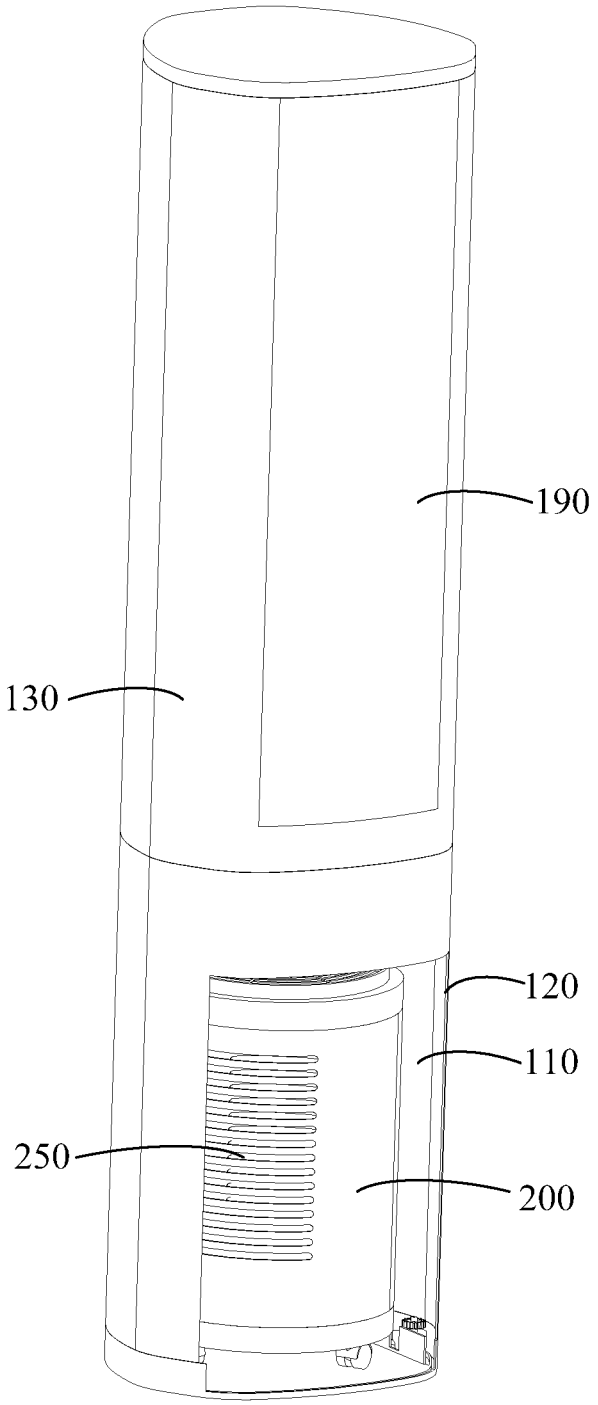
FIG. 2 is a schematic structural view of the floor-standing air conditioner indoor unit in FIG. 1, the switch door is opened, and the sub-unit is located inside the storage cavity.
Figure 15:
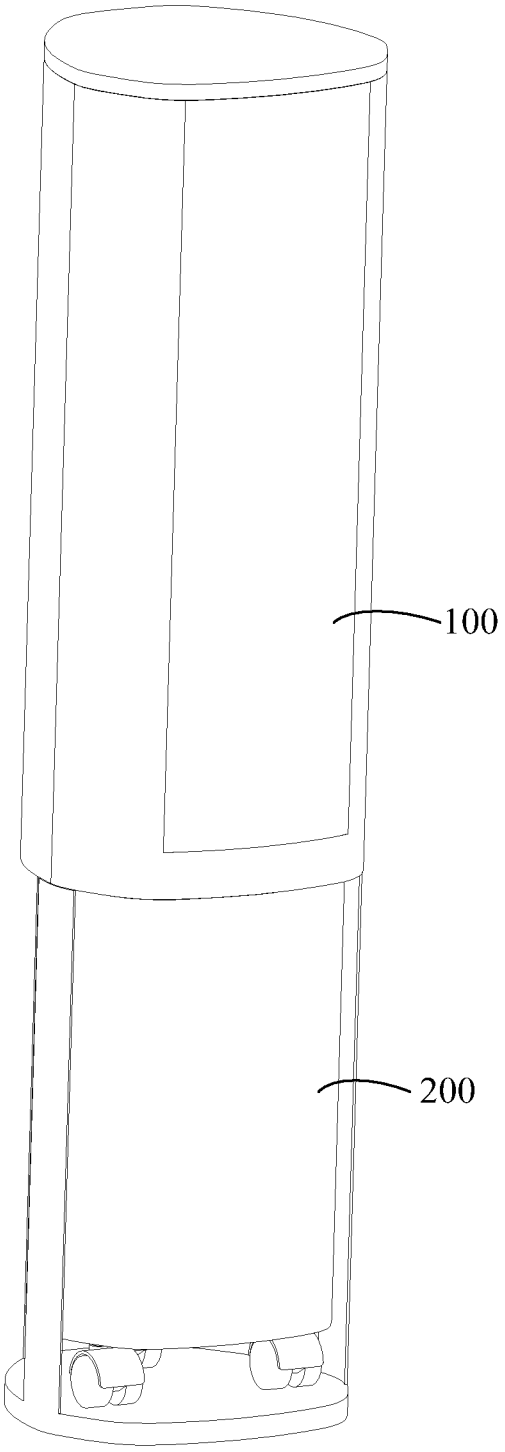
FIG. 15 is a schematic structural view of the floor-standing air conditioner indoor unit according to another embodiment of the present disclosure, the main unit and the sub-unit are connected to each other.
Figure 16:
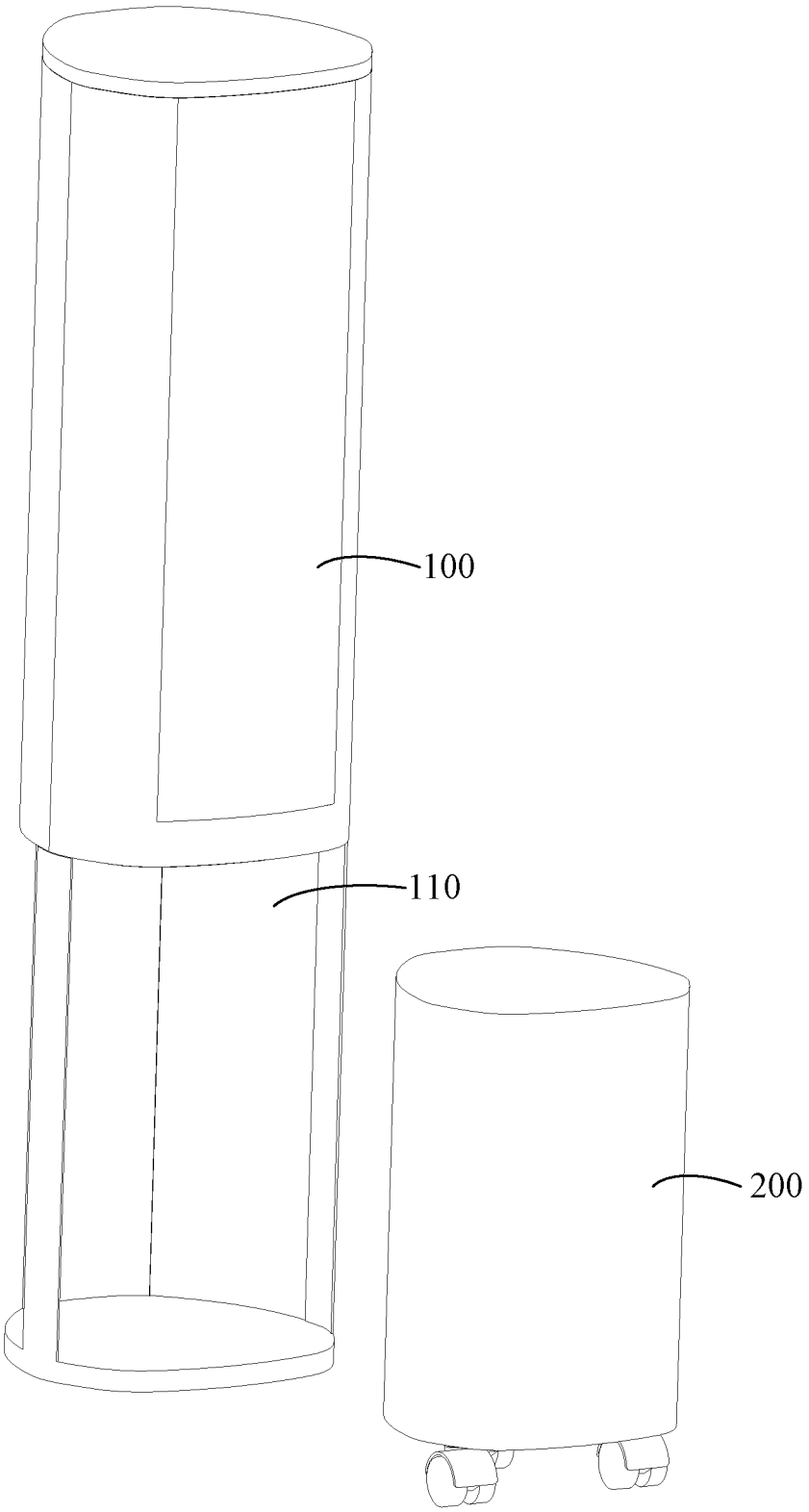
FIG. 16 is a schematic structural view of the floor-standing air conditioner indoor unit in FIG. 15, the main unit and the sub-unit are separated from each other.

In this embodiment, the storage cavity 110 may be located at the upper, middle or lower part of the main unit 100, and the storage cavity 110 may be located below or above the heat exchange air duct 190. Under a certain model, the storage cavity 110 and the heat exchange air duct 190 may be arranged side by side in the horizontal direction. Generally, the shape of the storage cavity 110 is adapted to the shape of the sub-unit 200, that is, in a non-working state, the sub-unit 200 is completely accommodated in the storage cavity 100. It is also possible that part of the sub-unit 200 is located inside the storage cavity 110 and part of the sub-unit 200 is located outside the storage cavity 110, that is, part of the sub-unit 200 is exposed to the main unit 100. As shown in FIG. 2 and FIG. 3, the storage cavity 110 may be formed by partially hollowing out the main unit 100. As shown in FIG. 15 and FIG. 16, the storage cavity may also be enclosed and formed by the support arms on the main unit 100. The sub-unit 200 is at least partially provided in the storage cavity of the main unit 100, compared with the splicing of the sub-unit 200 and the main unit 100 as a whole, it is easier to maintain the overall consistency after the two are connected, thereby improving the user experience.

If the sub-unit 200 is detachably installed in the storage cavity 110, the sub-unit 200 can be directly placed in the storage cavity 110 and separated from the storage cavity 110 by rolling, sliding or the like. The sub-unit 200 can also be limitedly installed in the storage cavity 110 by means of a limiting structure, for example, connected in the storage cavity 110 by means of a snap connection, a magnetic connection, or the like. There are many forms in which the sub-unit 200 is installed in the storage cavity 110 and separated from the storage cavity 110, which will not be listed here. The sub-unit 200 can be manually moved out of the storage cavity 110 by the user, so that the sub-unit 200 can be separated from the main unit 100. It is also possible to move out of the main unit 100 by controlling the sub-unit 200 autonomously. At this time, the storage cavity 110 needs to be disposed at the bottom of the main unit 100, so that the sub-unit 200 can move out of the storage cavity 110 autonomously. When there are multiple sub-units 200, the plurality of sub-units 200 may be installed in the same storage cavity 110, or may be installed in different storage cavities 110.

Figure 17:
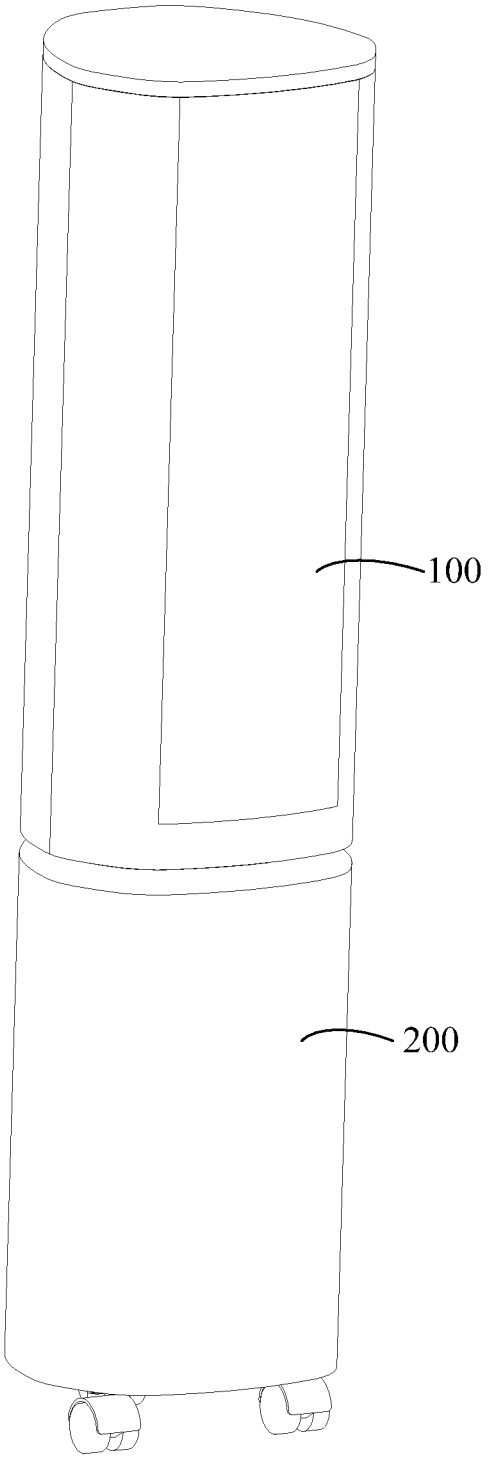
FIG. 17 is a schematic structural view of the floor-standing air conditioner indoor unit according to still another embodiment of the present disclosure, the main unit and the sub unit are connected to each other.
Figure 18:
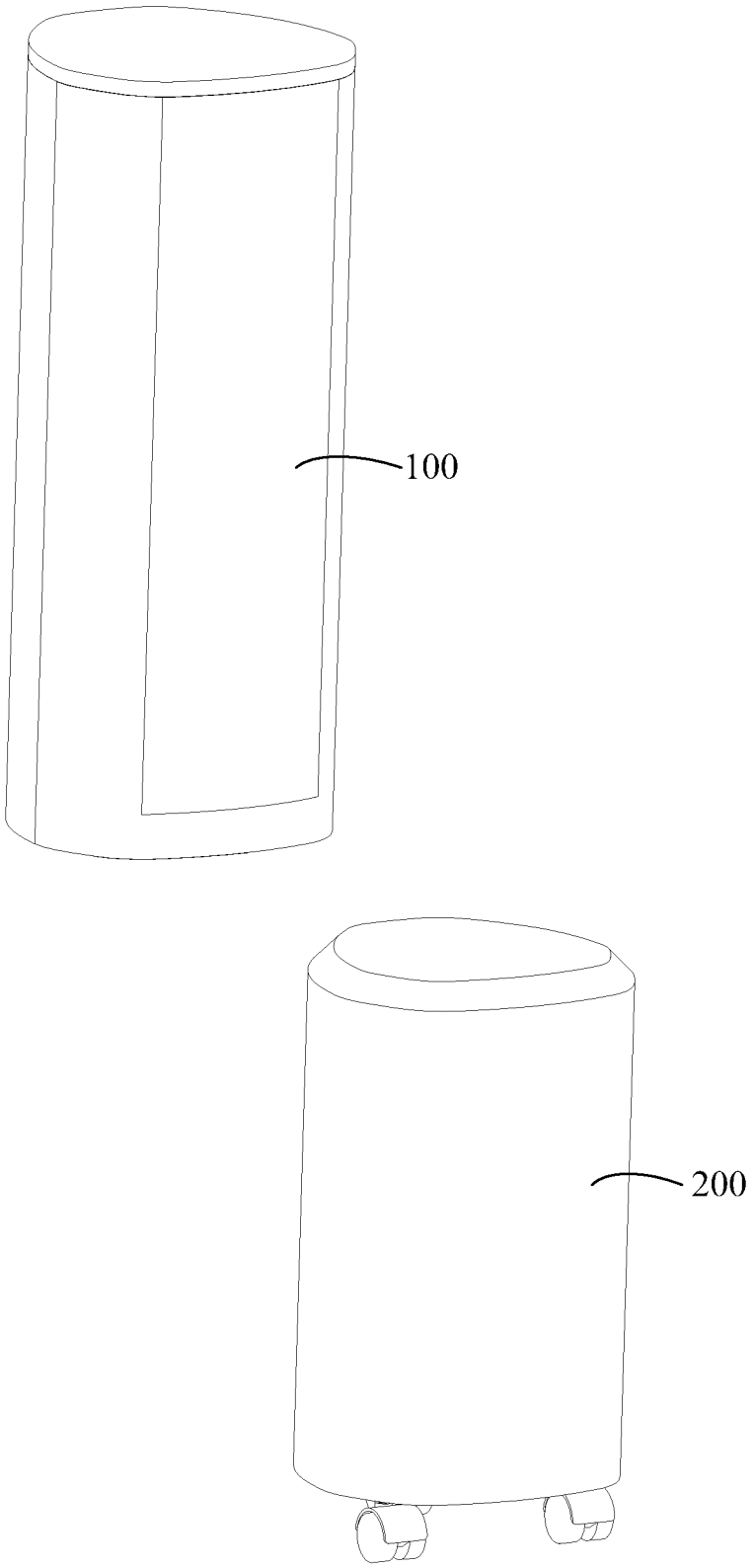
FIG. 18 is a schematic structural view of the floor-standing air conditioner indoor unit in FIG. 17, the main unit and the sub-unit are separated from each other.

In another embodiment, as shown in FIG. 17 and FIG. 18, the sub-unit 200 and the main unit 100 are connected to each other. At this time, the sub-unit 200 can be spliced at the lower end of the main unit 100, that is, the top of the sub-unit 200 is connected to the bottom of the main unit 100. The sub-unit 200 can also be spliced above the main unit 100, in this case, the bottom of the sub-unit 200 is connected with the top of the main unit 100. The sub-unit 200 can also be spliced at the side of the main unit 100, so that the side wall surface of the sub-unit 200 is connected with the side wall surface of the main unit 100. The sub-unit 200 is spliced with the main unit 100, which can reduce the volume and occupied space of the main unit 100. Specifically, the top of the sub-unit 200 and the bottom of the main unit 100 are spliced to each other. The sub-unit 200 can also be disassembled manually, so that the main unit may be separated from the sub-unit.

Further, as shown in FIG. 2 and FIG. 3, the main unit 100 extends in a vertical direction, the storage cavity 110 is located below the main unit 100, a side wall of the main unit 100 is provided with an installation opening 120 communicating with the storage cavity 110, and the control device is configured to control the mobile device 220 to drive the sub-unit body 210 to enter and separate from the storage cavity 110 through the installation opening 120.

In this embodiment, in order to facilitate separation of the sub-unit 200 from the storage cavity 110, the shape of the installation opening 120 is adapted to the vertical cross-sectional shape of the sub-unit 200. The installation opening 120 should be larger than the maximum vertical cross section of the sub-unit 200, so that the sub-unit 200 can be separated from the storage cavity 110 through the installation opening 120. In order to enable the sub-unit 200 to enter and exit the storage cavity 110 smoothly, the bottom of the storage cavity 110 should be formed by the bottom plate of the main unit 100. The height of the bottom of the storage cavity 110 is the thickness of the bottom plate of the main unit 100, which is generally 0.6 mm to 1 mm, which enables the sub-unit 200 to enter and exit the storage cavity 110 smoothly and autonomously. The control device can control the mobile device 220 to drive the sub-unit body 210 into and out of the storage cavity 110 through the installation opening 120. The sub-unit 200 can realize autonomous movement and escape from the storage cavity 110 without manual movement, so that the sub-unit 200 has a high degree of automation and is more intelligent, thereby improving the user experience. In the embodiment in which the sub-unit 200 is manually removed from the storage cavity 110, the storage cavity 110 may also be located at the upper and middle parts of the main unit body 130. In order to further enhance the structural strength of the main unit 100, the cross-sectional area of the lower part of the main unit 100 is larger than the cross-sectional area of the upper part of the main unit 100. It is also possible to make the cross-sectional area of the main unit 100 gradually increase from top to bottom. In this way, the space at the lower part of the main unit 100 is large, so that the storage cavity 110 provided at the lower part of the main unit 100 is sufficient to accommodate the sub-unit 200. After the sub-unit 200 is moved out of the storage cavity 110, the lower part of the main unit 100 is sufficient to support the entire main unit 100, thereby improving the stability of the main unit 100.

On the basis of the above embodiments, as shown in FIG. 1 to FIG. 12, the main unit 100 further includes a main unit body 130 and a switch door 140, the indoor heat exchange module is installed in the main unit body 130, the storage cavity 110 is formed in the main unit body 130, a side wall of the main unit body 130 is provided with the installation opening 120, and the switch door 140 is opened or closed to cover the installation opening 120.

In this embodiment, the switch door 140 can be a single door or a double door, which can be selected and designed according to actual needs. In an embodiment, the switch door 140 includes two sub-doors 142, and the two sub-doors 142 are arranged side by side along the width direction of the installation opening 120. By making the switch door 140 have two sub-doors 142 arranged side by side along the width direction of the installation opening 120, the switch door 140 occupies less space when opened, the movement distance of a single door is small, and the control is more precise. The switch door 140 can be opened or closed to cover the installation opening 120. When the sub-unit 200 needs to be separated from the main unit 100 and enter the room to work independently, only by opening the switch door 140, the sub-unit 200 can be automatically moved out, and the mobile air supply, purification, humidification, dehumidification, sterilization, etc. are carried out in the house, with a high degree of automation and simple and convenient operation. When the sub-unit 200 is not needed, the switch door 140 is closed to hide the sub-unit 200 in the main unit 100, thereby ensuring the consistency of the whole machine and effectively preventing dust from entering the storage cavity 110. In other embodiments, the switch door 140 may not be provided, so that the installation opening 120 is open, and the sub-unit 200 can be moved out or moved into the storage cavity 110 at any time.

In an embodiment, the switch door 140 is detachably connected to the main unit body 130 to open or close the installation opening 120. The switch door 140 can be installed at the main unit body 130 by means of snap connection, magnetic suction connection, suction cup connection, groove rail connection and the like. The switch door 140 is connected to the main unit body 130 in a detachable manner, and has a simple structure, easy implementation and low production cost.

Figure 6:
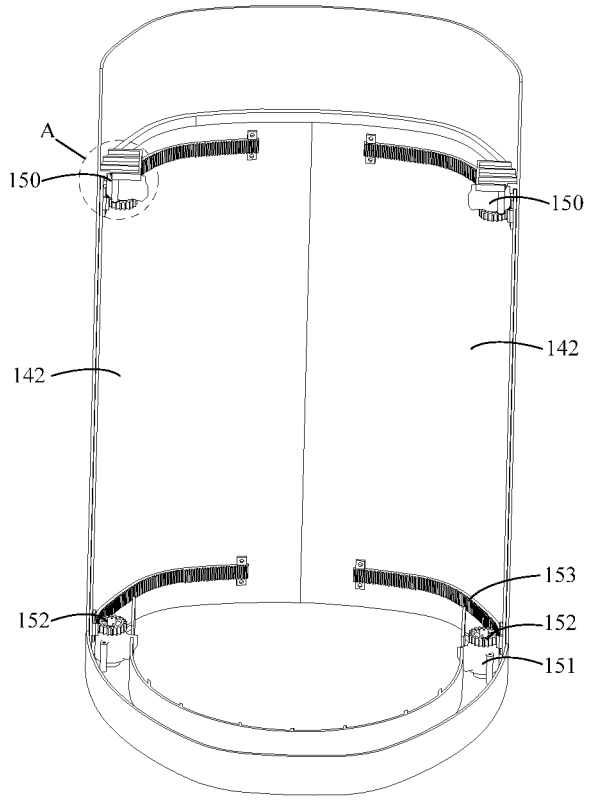
FIG. 6 is a schematic structural view of a switch door matching structure according to an embodiment of the present disclosure.
Figure 7:
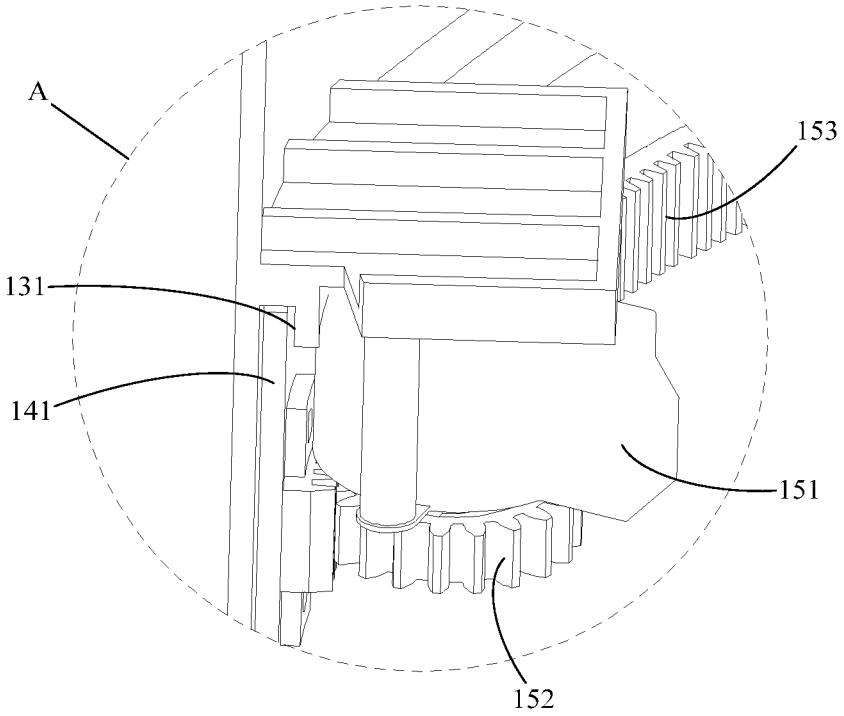
FIG. 7 is a partial enlarged view at portion A in FIG. 6.
Figure 8:
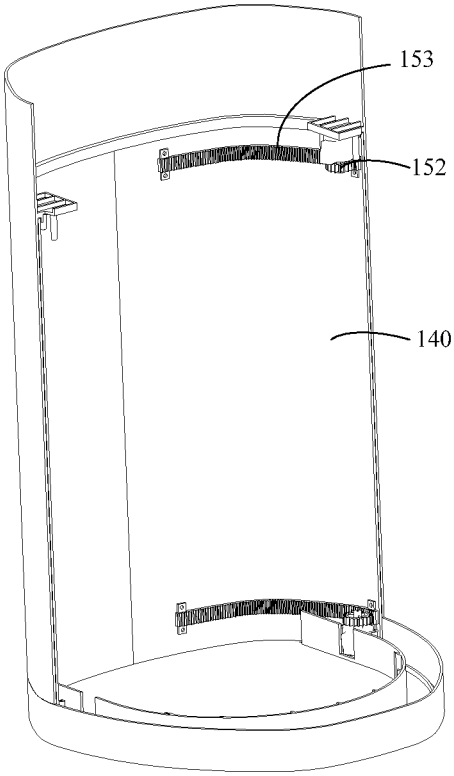
FIG. 8 is a schematic structural view of the switch door matching structure according to another embodiment of the present disclosure.
Figure 9:
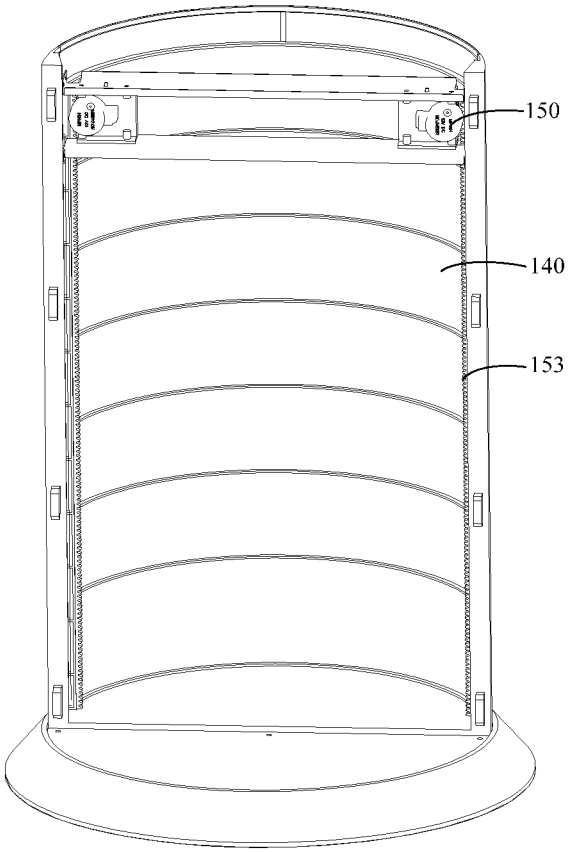
FIG. 9 is a schematic structural view of the switch door matching structure according to yet another embodiment of the present disclosure, the switch door is in a closed state.
Figure 10:
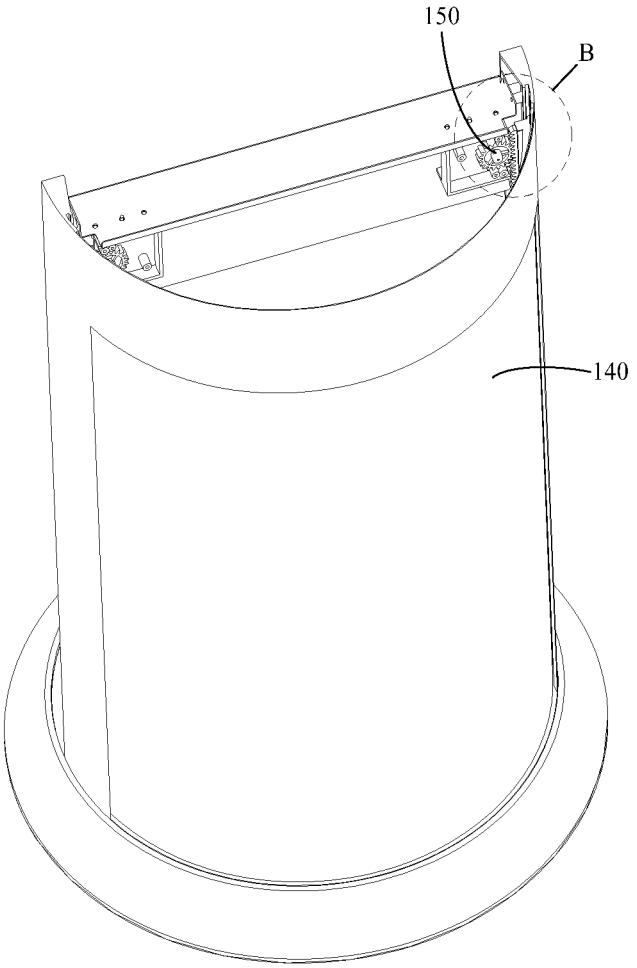
FIG. 10 is a schematic structural view of the switch door matching structure in FIG. 9 from another perspective.
Figure 11:
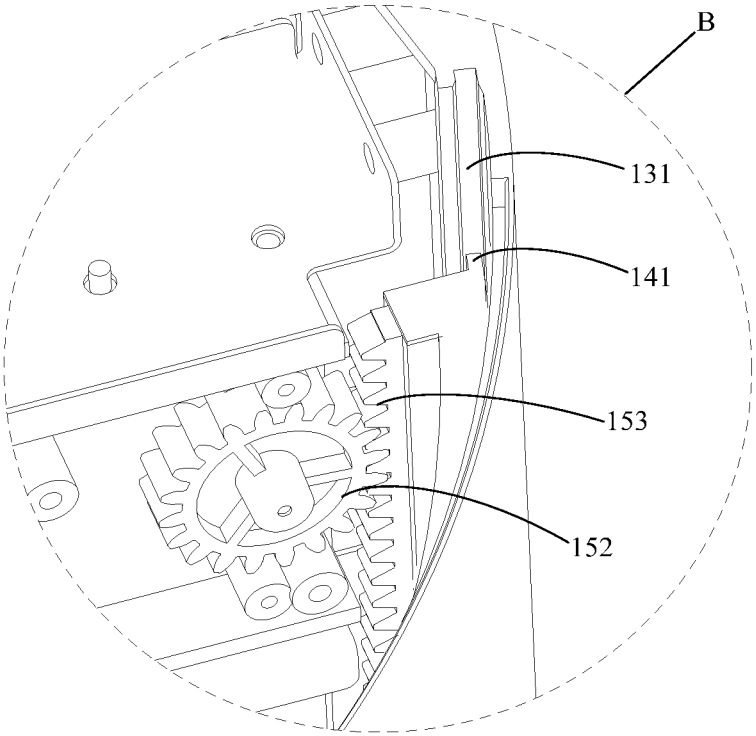
FIG. 11 is a partial enlarged view at portion B in FIG. 10.
Figure 12:
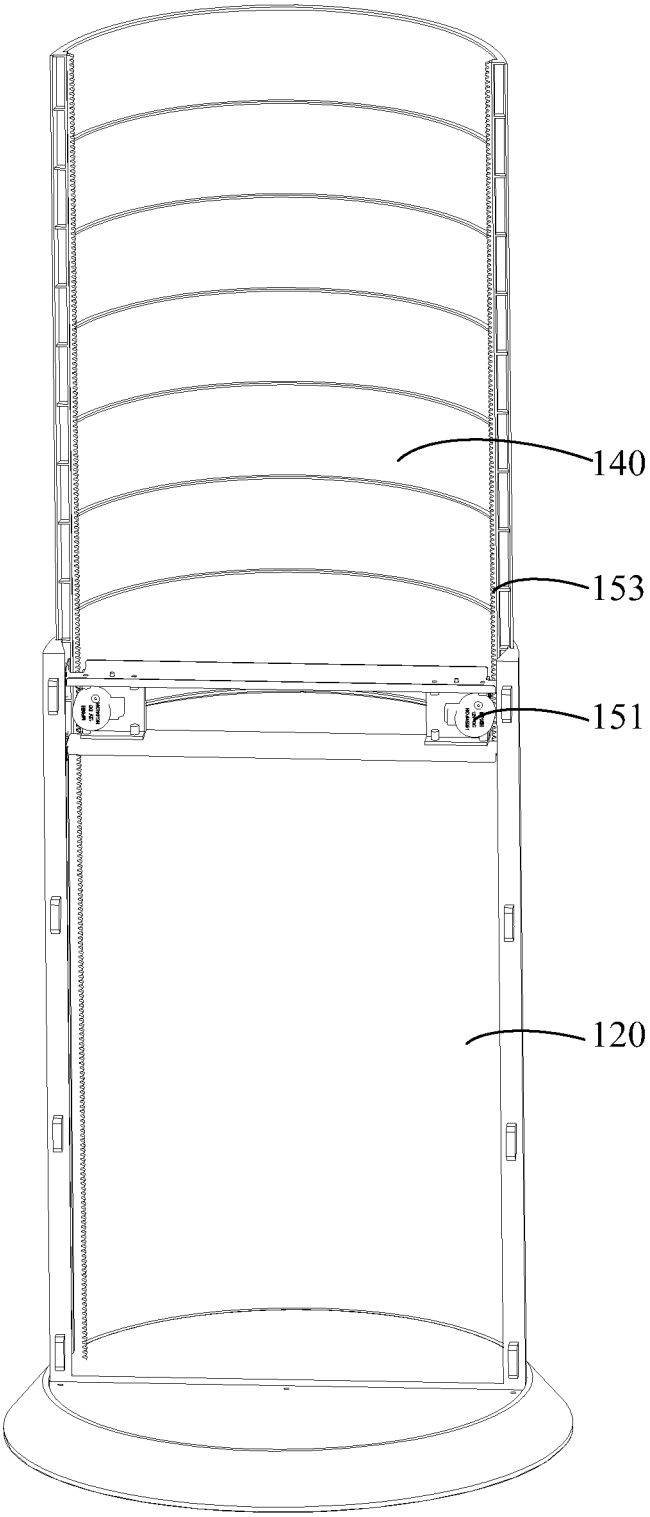
FIG. 12 is a schematic structural view of the switch door matching structure in FIG. 9, the switch door is in an open state.

In another embodiment, as shown in FIG. 6 to FIG. 8, the switch door 140 is rotatably connected to the main unit body 130 to open or close the installation opening 120. The switch door 140 is rotated in the circumferential direction of the main unit body 130 to open the installation opening 120. The switch door 140 can be hinged on the main unit body 130 to open the installation opening 120 by opening the door outward. The switch door 140 can also be opened through the arc-shaped guide rail 141 or the arc-shaped rack, so as to realize the rotation opening of the switch door 140. The rotation opening of the switch door 140 is simple, quick, and easy to implement. The switch door 140 can be manually turned to open or close the installation opening 120. The switch door 140 can also be driven to rotate by the drive device 150 to open or close the installation opening 120. In yet another embodiment, the switch door 140 is configured as a rolling shutter door, so that the switch door 140 is rolled up and down or the switch door 140 is rolled sideways to realize the opening of the installation opening 120.

In some embodiments, as shown in FIG. 9 to FIG. 12, the switch door 140 is slidably connected to the main unit body 130 to open or close the installation opening 120. The switch door 140 slides in the vertical direction to open the main unit body 130. The installation opening 120 can be opened or closed by sliding the switch door 140 up and down by arranging the chute slide rail, the rack structure 153 extending in the vertical direction, and the like. By sliding up and down to open the switch door 140, the opening method is simple, quick, and easy to implement. The switch door 140 can be manually slid to open or close the installation opening 120. The switch door 140 can also be driven to slide by the drive device 150 to open or close the installation opening 120. In one embodiment, the switch door 120 is configured as a retractable door, so that the switch door 120 can be extended and retracted along the vertical direction, the left-right direction or the circumferential direction of the main unit 100 to open or close the installation opening 120.

As shown in FIG. 5 to FIG. 12, the main unit 100 further includes a drive device 150, and the drive device 150 is connected to the switch door 140 to drive the switch door 140 to rotate to open the installation opening 120 or slide to open the installation opening 120. The drive device 150 may be a drive motor 151, a drive cylinder and other structures. The drive shaft of the drive motor 151 can be directly connected to the switch door 140, or indirectly connected to the switch door 140 through a transmission structure, such as a gear 152, a rack and other structures, so as to drive the switch door 140 to rotate and open. The drive shaft of the drive device 150 drives the switch door 140 to slide open through the gear 152, the rack and other structures. The drive device 150 drives the switch door 140 to open, so that the door body is automatically opened, the degree of intelligence is high, and the user experience is good.

The drive device 150 includes a drive motor 151, a gear 152, and a rack structure 150 meshed with the gear 152, the gear 152 is installed at the main unit body 130, the rack structure 153 is installed at the switch door 140, the drive motor 151 is connected to the gear 152, to drive the gear 152 to drive the rack structure 153 to move, so that the switch door 140 is configured to open or close the installation opening 120. The drive motor 151 has the advantages of small size and sufficient driving force. The gear 152 and the rack structure 153 cooperate with the drive motor 151 to precisely control the opening and closing of the switch door 140.

In an embodiment, as shown in FIG. 9 to FIG. 12, the rack structure 153 extends in the vertical direction, so that the switch door 140 may open or close the installation opening 120 in the vertical direction. Through the rack structure 153 extending up and down, the switch door 140 is slid to open and close the installation opening in the vertical direction. At this time, in order to maintain the consistency of the overall appearance, the switch door 140 can be slid upward to open the installation opening 120, and then the switch door 140 can be hidden inside the main unit 100, that is, the switch door 140 slides up and down inside the main unit 100. The main body is provided with a moving space for sliding the switch door 140. A mounting plate is provided at the position of the main unit body 130 corresponding to the storage cavity 110. The gear 152 and the drive motor 151 are mounted on the mounting plate, to drive the gear 152 to drive the rack move, and drive the switch door 140 to move up and down.

In another embodiment, as shown in FIG. 6 to FIG. 8, the rack structure 153 is installed at an inner side of the switch door 140, and the rack structure 153 extends in the width direction of the switch door 140, so that the switch door 140 opens or closes the installation opening 120 along the circumferential direction of the main unit body 130. Through the rack structure 153 extending along the width direction of the switch door 140, when the motor 151 is driven to drive the gear 152 to rotate, the rack structure 153 can be driven to move in the circumferential direction, so that the switch door 140 rotates along the circumferential direction of the main unit body 130 to open or close the installation opening 120. At this time, in order to maintain the consistency of the overall appearance, the switch door 140 may be rotated to open the installation opening 120, and then the switch door 140 may be hidden inside the main unit 100.

As shown in FIG. 7 to FIG. 11, one of the switch door 140 and the main unit body 130 is provided with a guide rail 141, the other one of the switch door 140 and the main unit body 130 is provided with a guide groove 131 matching the guide rail 141, an extension direction of the guide rail 141 is consistent with an extension direction of the rack structure 153, and when the switch door 140 opens the installation opening 120, the switch door 140 is located in the storage cavity 110. By arranging the guide rail 141 and the guide groove 131, the extension direction of the guide rail 141 is consistent with the extension direction of the rack structure 153, when the switch door 140 moves along the extension direction of the rack structure 153, it can play the role of guiding and limiting, so as to avoid the phenomenon that the switch door 140 is stuck due to the deviation of the meshing of the rack structure 153 and the gear 152. When the switch door 140 opens the installation opening 120, the switch door 140 is located in the storage cavity 110, and the switch door 140 can be hidden. On the one hand, it saves space, and on the other hand, it ensures the overall consistency, making the appearance of the whole machine more beautiful.

In an embodiment, as shown in FIG. 5 to FIG. 12, the main unit 100 includes at least two drive devices 150. When the rack structure 153 extends in the vertical direction, two of the drive devices 150 are provided at both ends of the switch door 140 in the width direction. Both ends of the switch door 140 in the width direction are provided with rack structures 153 extending in the vertical direction, and each drive device 150 is matching the corresponding rack structure 153. When the rack structure 153 extends in the width direction of the switch door 140, two of the drive devices 150 are provided at both ends of the switch door 140 in the vertical direction. Both ends of the switch door 140 in the vertical direction are provided with rack structures 153 extending along the width direction of the switch door 140, and each drive device 150 cooperates with the corresponding rack structure 153. By arranging two sets of drive devices 150 and enabling the two sets of drive devices 150 to drive both ends of the switch door 140 to open at the same time, the force of the switch door 140 is made more uniform. Therefore, the opening and closing of the switch door 140 is made smoother, and the opening and closing of the switch door 140 is prevented from being unevenly subjected to force, resulting in jamming and other phenomena.

In an embodiment, the floor-standing air conditioner indoor unit further includes an electric control box, and a sensing device electrically connected to the electric control box. The electric control box is installed at the main unit body 130, and the electric control box is configured to control the drive device 150 to drive the switch door 140 to open after receiving a start-up signal from the sub-unit 200. The electric control box is further configured to control the drive device 150 to drive the switch door 140 to open when the sensing device senses that the sub-unit 200 moves outside the main unit 100 to approach the main unit 100. The electric control box is further configured to control the drive device 150 to drive the switch door 140 to close when the sensing device senses that the sub-unit 200 is repositioned in the storage cavity 110, and/or the sub-unit 200 is separated from the storage cavity 110.

Figure 13:
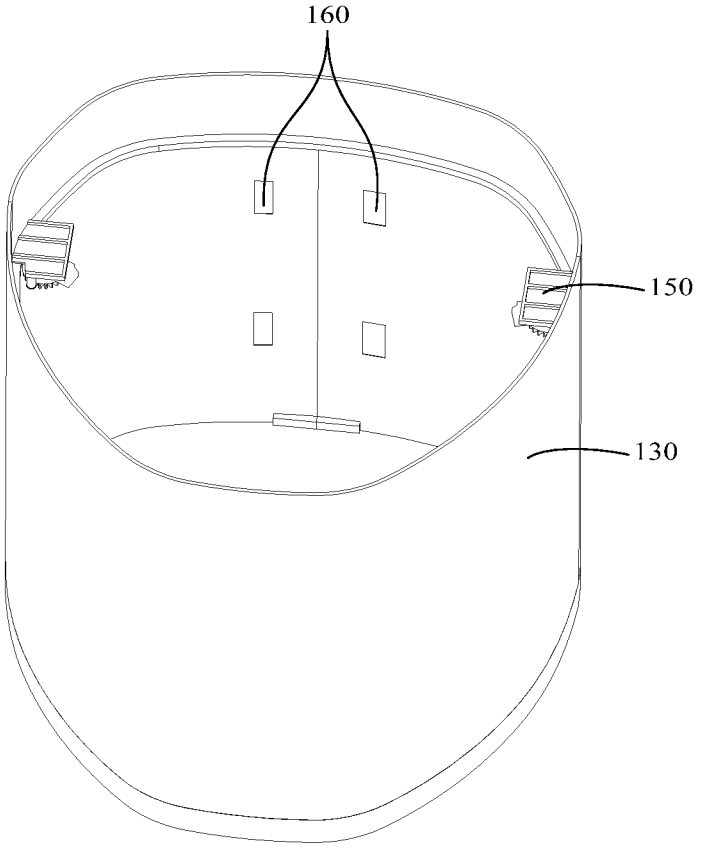
FIG. 13 is a partial schematic structural view of a main unit of the floor-standing air conditioner indoor unit according to an embodiment of the present disclosure, the switch door is in a closed state.
Figure 14:
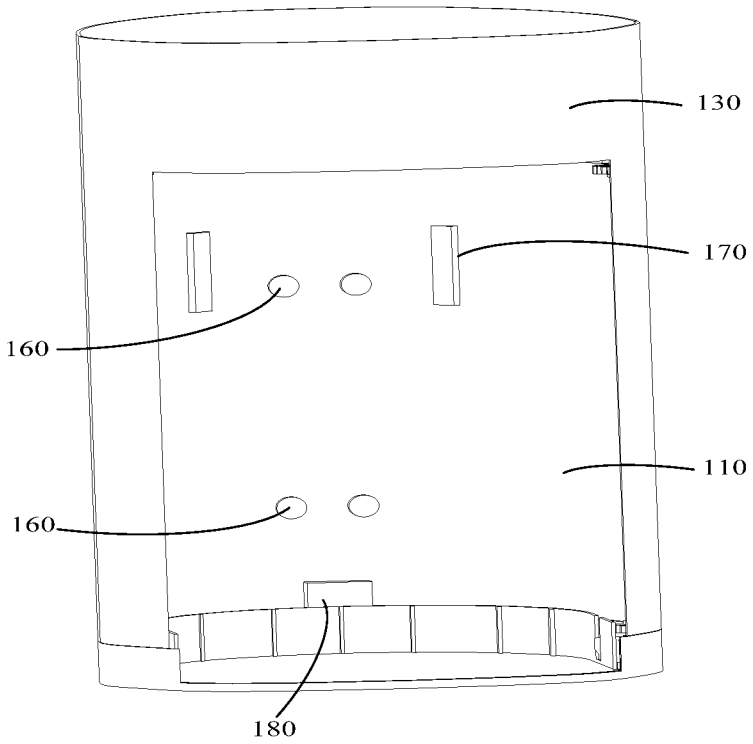
FIG. 14 is a schematic structural view of the main unit in FIG. 13 from another perspective, the switch door is in an open state.

In this embodiment, the sub-unit 200 can be powered on by means of a power-on button, infrared remote control, mobile phone APP, and autonomous startup, etc., and transmit the power-on signal to the power-on sensor of the sensing device, and the power-on sensor sends the power-on signal to the electric control box. After receiving the power-on signal of the sub-unit 200, the electric control box controls the drive device 150 to drive the switch door 140 to open. As shown in FIG. 4, FIG. 13 and FIG. 14, in an embodiment, the sensing device includes a signal receiver 160 and a signal generator 230. The signal generator 230 is installed at the sub-unit body 210. The signal receiver 160 is installed at the main unit 100. The signal receiver 160 is configured to transmit a signal for opening the switch door 140 to the electric control box when the signal generator 230 senses that the sub-unit 200 moves outside the main unit 100 to be close to the main unit 100. The signal generator 230 may be an infrared sensor, a laser sensor, a visual sensor, an ultrasonic sensor, or other sensors capable of transmitting distance information. The signal receiver 160 receives the signal transmitted from the signal generator 230 and determines the distance between the sub-unit 200 and the main unit 100. If the sub-unit 200 moves towards the main unit 100 and the distance between the sub-unit 200 and the main unit 100 is less than or equal to a preset approaching distance, it means that the sub-unit 200 needs to be repositioned. At this time, the signal receiver 160 generates a signal for opening the switch door 140 to the electric control box, and the electric control box controls the drive device 150 to drive the switch door 140 to open. In this way, the automatic opening of the switch door 140 is realized, so that when the sub-unit 200 is being repositioned, it is fully automated without manual operation, the degree of intelligence is high, the operation is simple and convenient, and the control is precise. In other embodiments, the signal generator 230 may also be provided on the main unit 100 and the signal receiver 160 may be provided on the sub-unit 200, so as to realize pulling the sub-unit 200 to move to a position close to the switch door 140. It is also possible that the signal generator 230 can both generate and receive signals, and the signal receiver 160 can both generate and receive signals.

It can be understood that a limit structure and a reposition sensor may be provided in the storage cavity 110. When the sub-unit 200 cooperates with the limit structure to achieve repositioning, the reposition sensor is triggered, and the reposition sensor transmits a signal for closing the switch door 140 to the electric control box, so that the electric control box controls the drive device 150 to drive the switch door 140 to close. When the sensing device senses that the sub-unit 200 is separated from the storage cavity 110, the drive device 150 is controlled to drive the switch door 140 to close, so that when the sub-unit 200 moves indoors, the switch door 140 is closed, and the overall consistency of the main unit 100 is good. The automatic opening and closing of the switch door 140 is realized through the sensing device, which has intelligent control, high degree of automation, simple and convenient operation, and precise control.

As shown in FIG. 14, the sensing device further includes a body sensor 170, and the body sensor 170 is configured to transmit a signal for closing the switch door 140 to the electric control box when it senses that the sub-unit 200 is separated from the storage cavity 110. The body sensor 170 may specifically be a timing sensor, a distance sensor, or the like. When the body sensor 170 determines that the sub-unit 200 is separated from the storage cavity 110 through parameters such as time and distance, a signal for closing the switch door 140 is transmitted to the electric control box. When the sub-unit 200 is working when separated from the main unit 100, the switch door 140 can be automatically closed to ensure the overall consistency of the main unit 100. In another embodiment, the signal receiver 160 is also configured to transmit a signal for closing the switch door 140 to the electric control box when the signal generator 230 senses that the sub-unit 200 is far away from the main unit 100. In this way, when the signal receiver 160 receives that the sub-unit 200 is far away from the main unit 100, that is, when the distance between the sub-unit 200 and the main unit 100 is greater than or equal to the preset distance, a signal for closing the switch door 140 is sent to the electric control box, and the electric control box controls the switch door 140 to close. In this way, the signal receiver 160 can be directly used without additionally disposing the body sensor 170, which simplifies the overall control system.

Further, as shown in FIG. 4, FIG. 5 and FIG. 14, the sensing device further includes a sub-unit magnetic attraction module 240 and a main unit magnetic attraction module 180. The sub-unit magnetic attraction module 240 is installed at the sub-unit 200. The main unit magnetic attraction module 180 is installed at an inner wall surface of the storage cavity 100. After the sub-unit 200 is moved to the storage cavity 110 and the sub-unit magnetic attraction module 240 is docked with the main unit magnetic attraction module 180, the sensing device is configured to transmit a signal for closing the switch door 140 to the electric control box.

In this embodiment, an annular limiting protrusion may also be provided in the storage cavity 110 to limit the position of the chassis of the sub-unit 200. After the sub-unit magnetic attraction module 240 is magnetically connected with the main unit magnetic attraction module 180, the sub-unit 200 is repositioned to a preset position, thereby ensuring the accurate repositioning of the sub-unit 200. When the sub-unit magnetic attraction module 240 is docked with the main unit magnetic attraction module 180, it indicates that the sub-unit 200 has been repositioned. At this time, by triggering the reposition sensor, a signal for closing the switch door 140 can be transmitted to the electric control box, so that the electric control box controls the switch door 140 to close, so as to realize the complete repositioning of the sub-unit 200. In this way, the opening and closing of the switch door 140 can be precisely controlled by the sensing device according to the movement state and use state of the sub-unit 200, realizing intelligent control, high degree of automation, simple and convenient operation, and precise control.

The present disclosure further provides an air conditioner. The air conditioner includes an air conditioner outdoor unit and a floor-standing air conditioner indoor unit communicated through a refrigerant pipe. The specific structure of the floor-standing air conditioner indoor unit refers to the above-mentioned embodiments. Since the air conditioner adopts all the technical solutions of the above-mentioned embodiments, it has at least all the beneficial effects brought by the technical solutions of the above-mentioned embodiments, which will not be repeated herein.

The present disclosure further provides an air conditioner indoor unit. Since the principle and basic structure are roughly the same, the technical solutions in the embodiments of the above-mentioned floor-standing air conditioner indoor unit are all applicable to the air conditioner indoor unit. That is, all the technical features in the above-mentioned floor-standing air conditioner indoor unit can be converted into the technical features in the air conditioner indoor unit of the present disclosure. On the basis of the above-mentioned embodiments, the specific structure of the air conditioner indoor unit is further described below.

Figure 19:
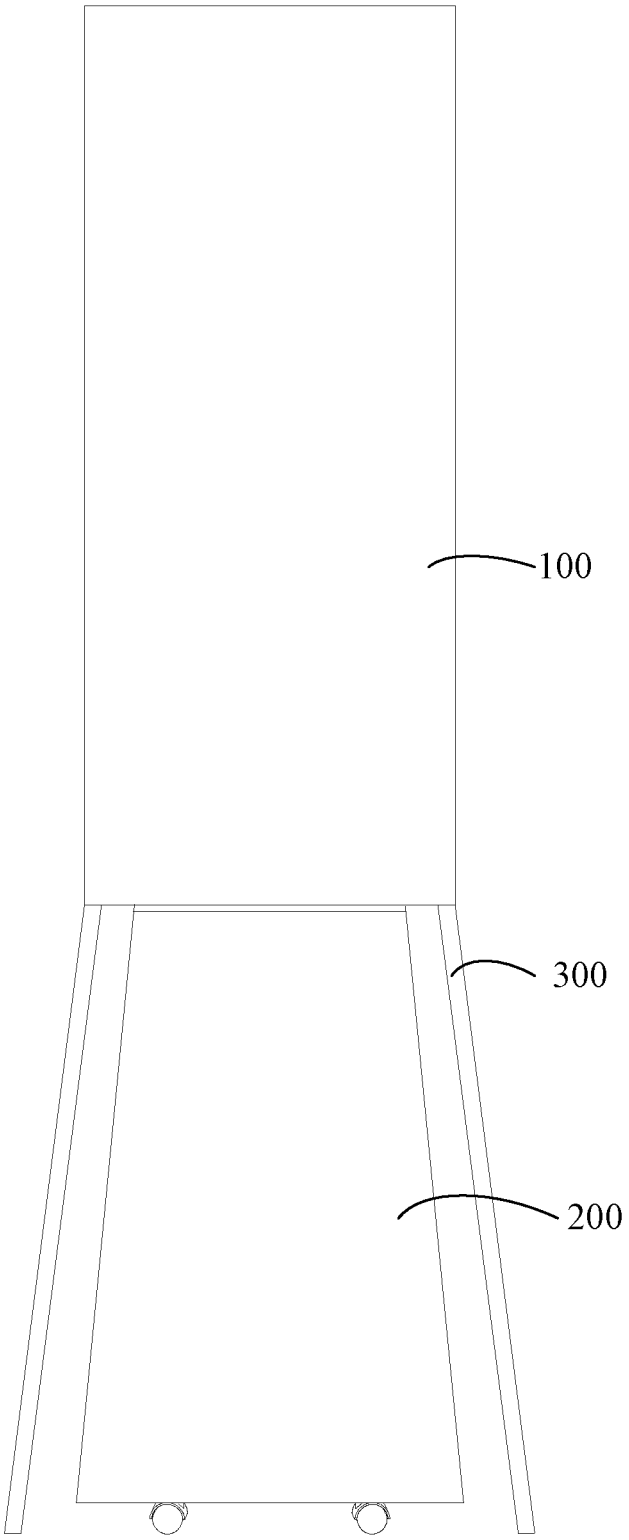
FIG. 19 is a schematic structural view of an air conditioner indoor unit according to an embodiment of the present disclosure.
Figure 20:
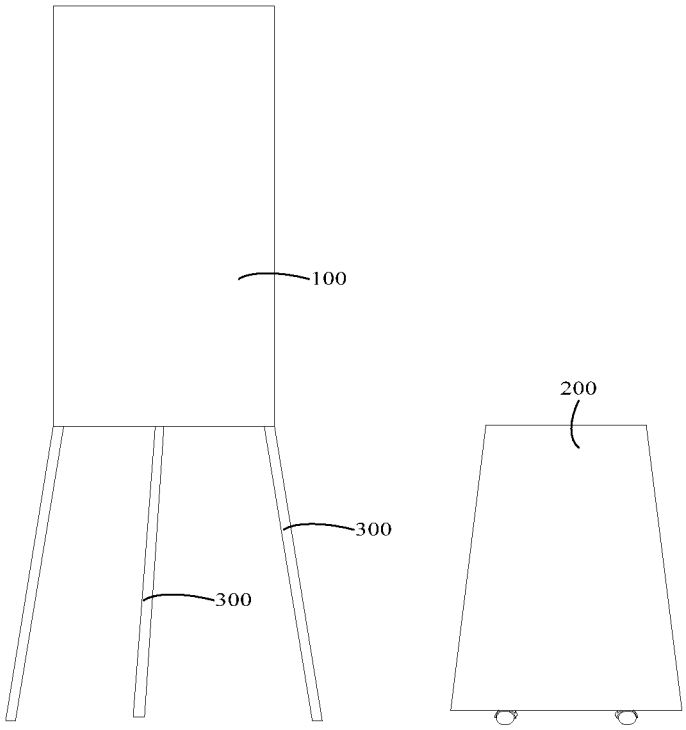
FIG. 20 is a schematic structural view of the indoor unit of the air conditioner in FIG. 19, wherein the main unit and the sub-unit are separated from each other.

In some embodiments of the present disclosure, as shown in FIG. 19 and FIG. 20, a bottom of the main unit 100 is provided with a bracket, and the main unit 100 is supported on the ground by the bracket. The sub-unit 200 is disposed below the main unit 100 and is detachably connected to the main unit 100.

In this embodiment, the bracket can be formed only by a plurality of support arms 300, or can be formed by the support arms 300 and a support ring or a support plate. The main unit 100 as a whole is installed at the ground through a bracket, and the height of the bottom of the main unit 100 relative to the ground may be higher than the height of the sub-unit 200. In this way, the entire sub-unit 200 is located at the lower part of the main unit 100, which can facilitate the autonomous movement of the sub-unit 200 and the autonomous connection with the main unit 100. The bracket and the main unit 100 may be integrally formed or formed separately. The bracket and the main unit 100 can also be detachably connected by means of screws, snaps, magnetic attraction, and the like.

Further, as shown in FIG. 19 and FIG. 20, the bracket includes a plurality of support arms 300, the plurality of support arms 300 are arranged around the circumference of the main unit 100, and the sub-unit 200 is located in a storage space enclosed by the plurality of support arms 300. Specifically, the number of the support arms 300 may be three, four, five, six, and the like. The bracket is formed only by the support arm 300. Compared with the support plate and the support ring, when the sub-unit 200 moves to the bottom of the main unit 100 autonomously, there is no need to cross the support plate or the support ring. The autonomous movement of the sub-unit 200 is smoother, and the working stability of the sub-unit 200 is improved.

In an embodiment, each support arm 300 is inclined outward from top to bottom. In this way, the bottoms of the plurality of support arms 300 are flared outward, thereby improving the installation stability of the main unit 100. The angle between the support arm 300 and the horizontal plane (ground) is greater than or equal to 30 degrees and less than or equal to 80 degrees. The angle between the support arm 300 and the horizontal plane (ground) may be 30 degrees, 45 degrees, 60 degrees, 75 degrees, 80 degrees, and the like. The angle between the support arm 300 and the horizontal plane is greater than or equal to 30 degrees and less than or equal to 80 degrees, which reduces the overall occupied space of the bracket while satisfying the height of the bottom of the main unit 100 relative to the ground.

In other embodiments, the bracket includes a support arm 300 and a support plate or a support ring provided at the lower end of the support arm 300. The upper end of the support arm 300 is connected to the periphery of the bottom of the main unit 100. The support plate and the support ring are disposed corresponding to the bottom of the main unit 100, and the area of the support plate or the support ring is greater than or equal to the cross-sectional area of the main unit 100. In this way, the main unit 100 can also be supported, and the sub-unit 200 has enough space to move under the main unit 100.

Figure 21:
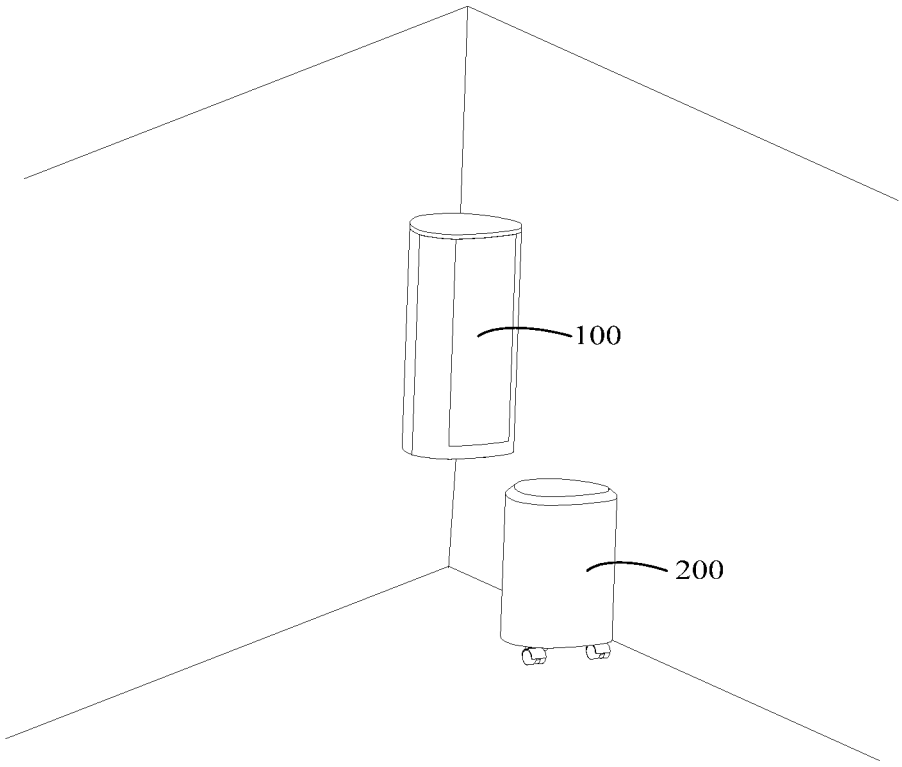
FIG. 21 is a schematic structural view of the air conditioner indoor unit according to another embodiment of the present disclosure.

In another embodiment, as shown in FIG. 21, the main unit 100 is mounted on the wall, and a height of the bottom of the main unit 100 relative to the ground is greater than or equal to a height of the sub-unit 200. The sub-unit 200 is provided below the main unit 100 and is detachably connected to the main unit 100. In this way, the main unit 100 does not need to be supported by the sub-unit 200, so that the sub-unit 200 can autonomously move below the main unit 100 to be connected to the main unit 100, or the sub-unit 200 can be moved to be separated from the main unit 100 to supply air indoors. The degree of automation is high, and the user does not need to manually disassemble the main unit 100, thereby improving the user experience. The main unit 100 is mounted on the corner of the wall. In this way, the space in the corner of the interior can be fully utilized, the remaining space can be freed up, and the user can have a better use experience.

Further, the edge of the top of the sub-unit 200 is curved. In this way, when the sub-unit 200 is repositioned to the main unit 100, the edge of the sub-unit 200 is prevented from scratching the main unit 100. The top of the sub-unit 200 can also be made into a circular truncated or spherical shape as a whole.

The present disclosure further provides an air conditioner. The air conditioner includes an air conditioner outdoor unit and an air conditioner indoor unit communicated through a refrigerant pipe. The specific structure of the air conditioner indoor unit refers to the above-mentioned embodiments. Since the air conditioner adopts all the technical solutions of the above-mentioned embodiments, it has at least all the beneficial effects brought by the technical solutions of the above-mentioned embodiments, which will not be repeated here.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. A floor-standing air conditioner indoor unit comprising:

a main unit including an indoor heat exchange module, a main unit body, and a switch door;

a sub-unit detachably connected to the main unit and including an air treatment module, the air treatment module being configured to operate independently in a scenario that the sub-unit is separated from the main unit; and an electric control box installed at the main unit body; wherein:

the indoor heat exchange module is installed in the main unit body;

a storage cavity is formed in the main unit body, and the sub-unit is at least partially installed in the storage cavity;

a side wall of the main unit body is provided with an installation opening;

the switch door is configured to be opened or closed to cover the installation opening; and the electric control box is configured to control a drive device of the main unit to drive the switch door to open after receiving a start-up signal from the sub-unit.

2. The floor-standing air conditioner indoor unit of claim 1, wherein the sub-unit includes:

a sub-unit body, the air treatment module being installed in the sub-unit body;

a mobile device installed at a bottom of the sub-unit body; and a control device configured to control the mobile device to drive the sub-unit body to move.

3. The floor-standing air conditioner indoor unit of claim 1, wherein:

the main unit extends in a vertical direction;

the storage cavity is located below the main unit;

the installation opening communicates with the storage cavity; and the sub-unit includes:

a sub-unit body, the air treatment module being installed in the sub-unit body;

a mobile device installed at a bottom of the sub-unit body; and a control device configured to control the mobile device to drive the sub-unit body to enter and separate from the storage cavity through the installation opening.

4. The floor-standing air conditioner indoor unit of claim 1, wherein:

the switch door is detachably, rotatably, or slidably connected to the main unit body to open or close the installation opening.

5. The floor-standing air conditioner indoor unit of claim 4, wherein the drive device is connected to the switch door and configured to drive the switch door to rotate or slide to open the installation opening.

6. The floor-standing air conditioner indoor unit of claim 1, wherein the drive device includes:

a gear installed at the main unit body;

a rack structure installed at the switch door and meshed with the gear; and a drive motor connected to the gear and configured to drive the gear to drive the rack structure to move, so that the switch door opens or closes the installation opening.

7. The floor-standing air conditioner indoor unit of claim 6, wherein:

one of the switch door and the main unit body is provided with a guide rail, and another one of the switch door and the main unit body is provided with a guide groove matching the guide rail;

an extension direction of the guide rail is consistent with an extension direction of the rack structure; and when the installation opening is opened, the switch door is located in the storage cavity.

8. The floor-standing air conditioner indoor unit of claim 6, wherein:

the rack structure extends in a vertical direction, and is configured to cause the switch door to open or close the installation opening in the vertical direction; or the rack structure is installed at an inner side of the switch door, the rack structure extends in a width direction of the switch door, and is configured to cause the switch door open or close the installation opening in a circumferential direction of the main unit body.

9. The floor-standing air conditioner indoor unit of claim 6, wherein:

the drive device is one of two drive devices of the main unit; and the two drive devices are:

provided at two ends, respectively, of the switch door in a width direction of the switch door with the rack structure of each of the two drive devices extending in a vertical direction; or provided at two ends, respectively, of the switch door in the vertical direction with the rack structure of each of the two drive devices extending in the width direction of the switch door.

10. The floor-standing air conditioner indoor unit of claim 1, wherein the switch door includes two sub-doors, and the two sub-doors are arranged side by side in a width direction of the installation opening.

11. The floor-standing air conditioner indoor unit of claim 1, further comprising:

a sensing device;

wherein the electric control box is electrically connected to the sensing device, and the electric control box is further configured to control the drive device of the main unit to:

drive the switch door to open in response to the sensing device sensing that the sub-unit moves outside the main unit to approach the main unit; and drive the switch door to close in response to the sensing device sensing that the sub-unit is repositioned in the storage cavity and/or the sub-unit is separated from the storage cavity.

12. The floor-standing air conditioner indoor unit of claim 11, wherein the sensing device includes:

a signal generator installed at the sub-unit body; and a signal receiver installed at the main unit body and configured to transmit a signal for opening the switch door to the electric control box in response to the signal receiver sensing that the sub-unit moves outside the main unit to approach the main unit through the signal generator.

13. The floor-standing air conditioner indoor unit of claim 12, wherein:

the signal receiver is further configured to transmit a signal for closing the switch door to the electric control box in response to the signal receiver sensing that the sub-unit is far away from the main unit through the signal generator; or the sensing device includes a body sensor, and the body sensor is configured to transmit a signal for closing the switch door to the electric control box in response to the body sensor sensing that the sub-unit is separated from the storage cavity.

14. The floor-standing air conditioner indoor unit of claim 11, wherein:

the sensing device includes:

a sub-unit magnetic attraction module installed at the sub-unit; and a main unit magnetic attraction module installed at an inner wall surface of the storage cavity; and the sensing unit is configured to, after the sub-unit is moved to the storage cavity and the sub-unit magnetic attraction module is docked with the main unit magnetic attraction module, transmit a signal for closing the switch door to the electric control box.

15. The floor-standing air conditioner indoor unit of claim 1, wherein the sub-unit and the main unit are spliced with each other.

16. The floor-standing air conditioner indoor unit of claim 15, wherein a top of the sub-unit is spliced with a bottom of the main unit.

17. The floor-standing air conditioner indoor unit of claim 1, wherein:

the indoor heat exchange module includes a heat exchange air duct;

the air treatment module includes an air treatment air duct; and when the sub-unit is connected to the main unit, the heat exchange air duct and the air treatment air duct are isolated from each other.

18. The floor-standing air conditioner indoor unit of claim 1, wherein the air treatment module includes at least one of an air supply assembly, a purification assembly, a humidification assembly, a dehumidification assembly, a sterilization assembly, or an aromatherapy assembly.

* * * * *